US008844990B2

(12) United States Patent
Bingham

(10) Patent No.: US 8,844,990 B2
(45) **Date of Patent: *Sep. 30, 2014**

(54) ADVERTISING DEVICE FOR AN IMPROVED GOLF BALL RETRIEVER WITH MAGNETIC ELEMENT

(75) Inventor: Edna Bingham, Garland, TX (US)

(73) Assignee: Ball Pro, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/364,253

(22) Filed: Feb. 1, 2012

(65) Prior Publication Data

US 2012/0131827 A1 May 31, 2012

Related U.S. Application Data

(63) Continuation-in-part of application No. 12/350,088, filed on Jan. 7, 2009, now Pat. No. 8,382,173.

(60) Provisional application No. 61/019,515, filed on Jan. 7, 2008.

(51) Int. Cl.

| | |
|---|---|
| ***A63B 47/02*** | (2006.01) |
| ***G09F 23/00*** | (2006.01) |
| *A63B 71/06* | (2006.01) |

(52) U.S. Cl.

CPC ..... *A63B 47/02* (2013.01); *G09F 23/00* (2013.01); *A63B 2071/0694* (2013.01); *G09F 23/0066* (2013.01)

USPC ..... 294/19.2; 40/124.06

(58) Field of Classification Search

USPC ..... 294/19.2, 209, 99.1; 40/124.06, 124.09; 56/328.1; 473/286, 460; 221/199, 307, 221/309

See application file for complete search history.

(56) References Cited

U.S. PATENT DOCUMENTS

| | | | | |
|---|---|---|---|---|
| 2,027,546 | A | 1/1936 | Macdonald | |
| D226,407 | S | 2/1973 | Doman | |
| 3,901,545 | A * | 8/1975 | Shott | 294/19.2 |
| 4,088,251 | A * | 5/1978 | Rodriguez | 294/19.2 |
| 4,522,438 | A * | 6/1985 | Logue | 294/19.2 |
| 4,678,108 | A * | 7/1987 | Inman | 294/19.2 |
| 4,787,161 | A * | 11/1988 | Feng | 40/334 |
| 4,798,219 | A | 1/1989 | Forde | |
| 5,188,410 | A * | 2/1993 | Summers | 294/19.2 |
| 5,466,027 | A * | 11/1995 | Hockey | 294/19.2 |
| 5,634,680 | A * | 6/1997 | Green | 294/19.2 |
| 5,755,632 | A * | 5/1998 | Eddy | 294/19.2 |
| 5,775,751 | A * | 7/1998 | Nelson | 294/19.2 |
| 7,086,971 | B2 | 8/2006 | Zmetra | |
| 2005/0052040 | A1 * | 3/2005 | Hellerson | 294/19.2 |
| 2006/0055189 | A1 * | 3/2006 | Dalsing et al. | 294/19.2 |

* cited by examiner

*Primary Examiner* — Paul T Chin

(74) *Attorney, Agent, or Firm* — Shannon W. Bates; Klemchuk Kubasta LLP

(57) ABSTRACT

An advertising device for an improved golf ball retriever is provided. The golf ball retriever includes a hollow shaft made of a clear plastic material wherein an advertising slip can be placed into the hollow shaft by the use of a pole. The shaft may include a grip on one end for secure maneuvering of the golf ball retriever during retrieval. The shaft includes a suction cup with a hollow center on the opposite end where the grip may be located for retrieving a golf ball. The top end of the shaft also includes apertures in the shaft that allow a hanging device to be removably affixed to the shaft of the golf ball retriever. The top end of the shaft also has an end cap removably attached to the shaft to enclose the top end of the hollow shaft.

18 Claims, 4 Drawing Sheets

ADVERTISING DEVICE FOR AN IMPROVED GOLF BALL RETRIEVER WITH MAGNETIC ELEMENT

CROSS REFERENCE TO RELATED APPLICATIONS

This application is a continuation-in-part of U.S. patent application Ser. No. 12/350,088, filed on Jan. 7, 2009, entitled "Advertising Device for an Improved Golf Ball Retriever," which claims the benefit of U.S. Provisional Patent Application No. 61/019,515, filed on Jan. 7, 2008, both of which are incorporated herein by reference in their entirety.

TECHNICAL FIELD

The present invention relates generally to advertising devices for golf equipment and in particular to an advertising device for an improved golf ball retriever.

BACKGROUND

Retrieving golf balls during the course of play requires players to constantly bend over and/or dismount from golf carts in order to retrieve golf balls from the ground. In certain games played on the course, the number of golf balls to be retrieved is increased by the nature of the game. For example, the problem is further aggravated from the requirements of team members playing in a golf game called Scramble. Under the rules of that game, all members of a team individually and sequentially have to drive their golf balls off the tee. The position of the golf ball that goes the farthest or is in the best lie for the next shot is selected as the chosen position where all team members hit their second shot. The other team members have to retrieve their golf balls and reposition them at the position of the selected ball and then each of the members strike their balls again from that position. When players retrieve their balls for repositioning to the lie of the selected ball, the players often have to disembark from golf carts and then physically bend over to pick up their ball. The problem becomes further exacerbated when balls are to be retrieved from undesirable areas such as water traps, sand traps, high weeds, and brush where the golf player may risk injury from plants, insects and the like.

Organizations that hold tournaments often seek sponsors for their events. The sponsors are typically able to advertise their goods or services on golf related equipment, such as tee boxes, flags on the green, and the like. Even when tournaments are not being held, companies that would like to increase their exposure to the potential clientele of golf players advertise their goods or services on golf related equipment, such as golf bags and golf balls. The typical advertising methods involved with golf related equipment, however, are either too expensive because of the cost of the golf equipment involved, do not last long enough to impress the potential customer, or are printed on golf related equipment that is discarded by the potential customer because it is not useful.

The need exists, therefore, for an effective advertising method that is less costly but useful to target the potential customer base of golf players.

As a result of the problems associated with retrieving golf balls, there are a variety of golf ball retrievers known in the art. One category of golf ball retriever is characterized by a rake-like structure used to scoop a golf ball. Another category of golf ball retriever uses two circular members connected by a spring mechanism on the end of a shaft to pick a golf ball up. However, these prior designs are cumbersome to use and often unreliable. The prior designs are also unable to accommodate any advertising device.

Thus, there exists a need to be able to safely and effectively retrieve a golf ball without repeatedly bending over or from a golf cart and to capitalize on the advertising opportunity of providing a useful device with an advertisement.

SUMMARY

These and other objects are achieved by the device of the present invention. By eliminating the complex designs, which include bail members, springs, elastic materials and the like, the golf ball retriever of the present invention is easier to use and more securely captures a golf ball upon retriev In accordance with one embodiment of the present invention, an advertising device for an improved golf ball retriever is provided. The golf ball retriever includes a hollow shaft made of a clear plastic wherein an advertising slip can be placed into the hollow shaft by the use of a pole so that a user can see the advertising slip through the shaft of the golf ball retriever. The advertising slip can be made of various paper or plastic products and is rolled into a cylinder shape so that it fits into the shaft of the golf ball retriever. The shaft may include a grip on one end for secure maneuvering of the golf ball retriever during retrieval. The shaft also includes a suction cup on the opposite end of the grip for retrieving a golf ball. To retrieve a golf ball on the course, a player can walk up to a ball, or drive the cart next to a ball, and simply place the suction cup of the golf ball retriever over the ball and press gently. The ball then remains in the suction cup. The player can then free his golf ball from the suction cup of the golf ball retriever for placement on the course for continued use. Thus, a player can retrieve his golf ball quickly without having to repeatedly bend over to retrieve a ball. The grip end of the shaft also has an end cap removably attached to the shaft to enclose the grip end of the shaft. The grip end of the shaft also includes apertures in the shaft that allow a hanging device to be removably affixed to the shaft of the golf ball retriever. Alternatively, the end cap itself may include an aperture that allows a hanging device to be removably affixed to the end cap. A user can then attach the golf ball retriever to his bag, such as on the towel ring. The end cap may also include a magnet so that the player may couple the golf ball retriever to his golf cart for convenience, as he drives from hole to hole and while taking shots.

Other technical features may be readily apparent to one skilled in the art from the following figures, descriptions and claims.

DETAILED DESCRIPTION

All references cited herein are incorporated by reference to the maximum extent allowable by law. To the extent a reference may not be fully incorporated herein, it is incorporated by reference for background purposes and indicative of the knowledge of one of ordinary skill in the art.

In the following detailed description of the preferred embodiments, reference is made to the accompanying drawings, which form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical mechanical and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
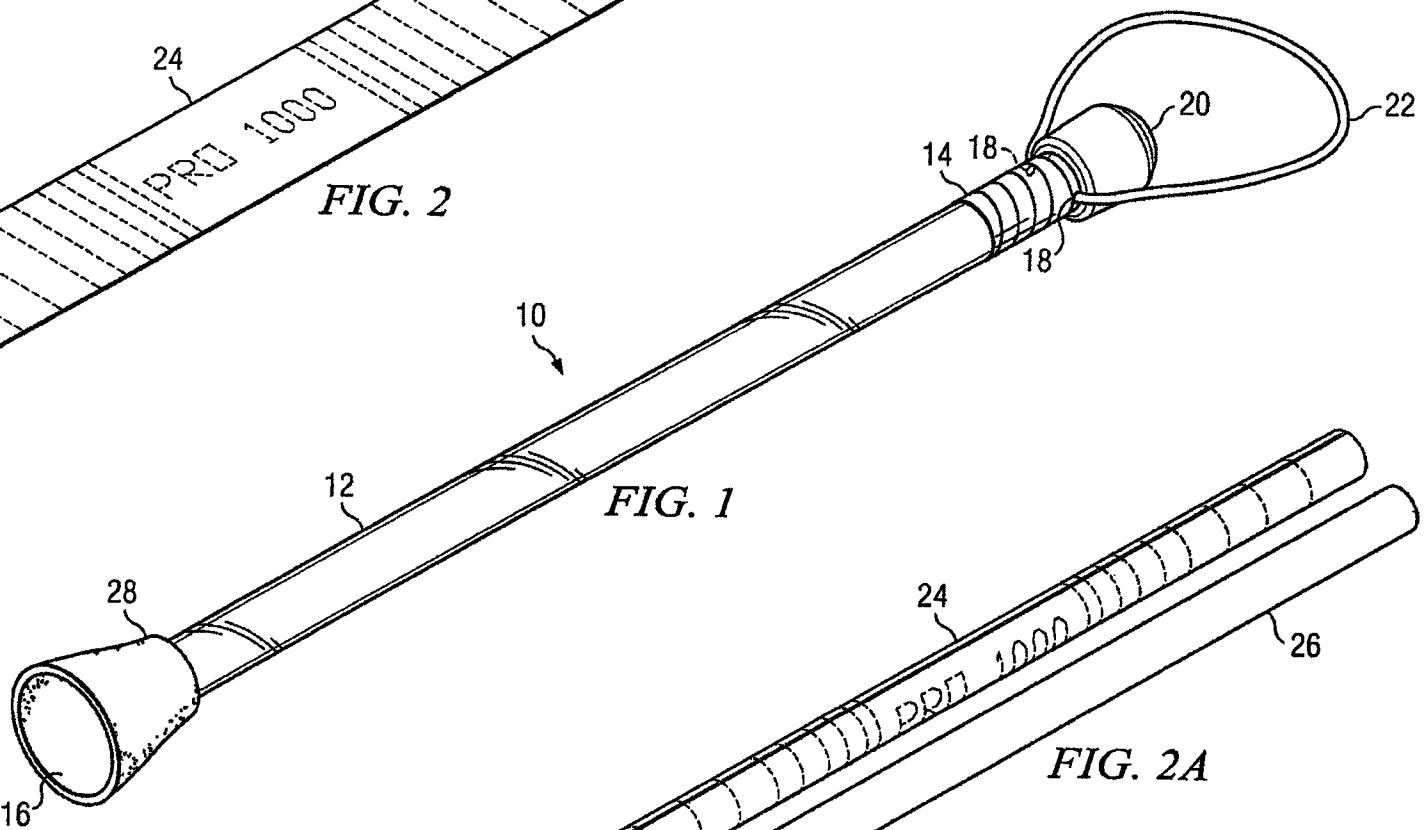
FIG. 1 is a perspective view of an improved golf ball retriever in accordance with one embodiment of the present invention.
Figure 2A:
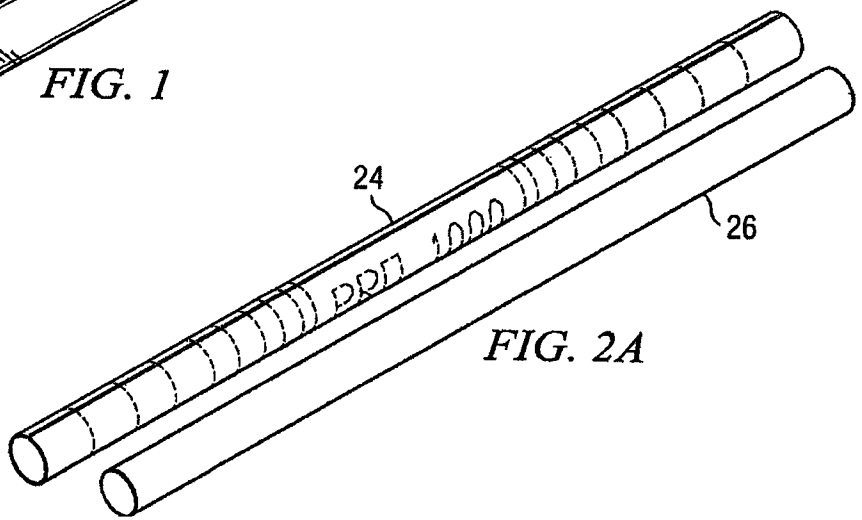
FIG. 2A is a perspective view of an advertising slip and insertion device to be used with an improved golf ball retriever in accordance with one embodiment of the present invention.
Figure 2:
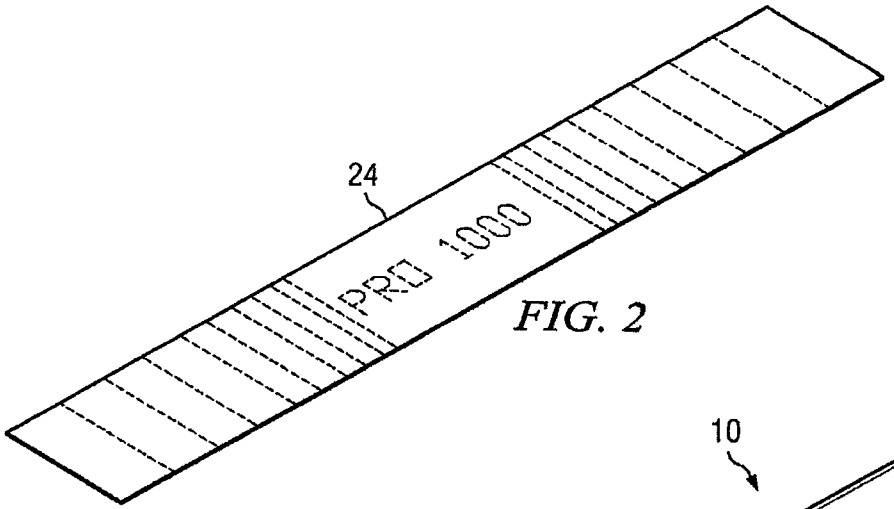
FIG. 2 is a perspective view of an advertising slip to be used with an improved golf ball retriever in accordance with one embodiment of the present invention.

FIG. 1 is a perspective view of an improved golf ball retriever 10 in accordance with one embodiment of the present invention. FIG. 2 is a perspective view of an advertising slip 24 used with the improved golf ball retriever 10 in accordance with one embodiment of the present invention. FIG. 2A is a perspective view of an advertising slip 24 and insertion device 26 used with the improved golf ball retriever 10 in accordance with one embodiment of the present invention. The golf ball retriever 10 includes a shaft 12 made of a sturdy clear polymer-based plastic. One skilled in the art will understand that the utility of the golf ball retriever 10 is not diminished by the use of other materials for the shaft 12, such as any sturdy clear material that allows the advertising slip 24 to be seen through the shaft 12. The shaft 12 is hollow such that an advertising slip 24 can travel through the shaft 12 when rolled into a cylinder shape 24 as shown in FIG. 2A.

Figure 5A:
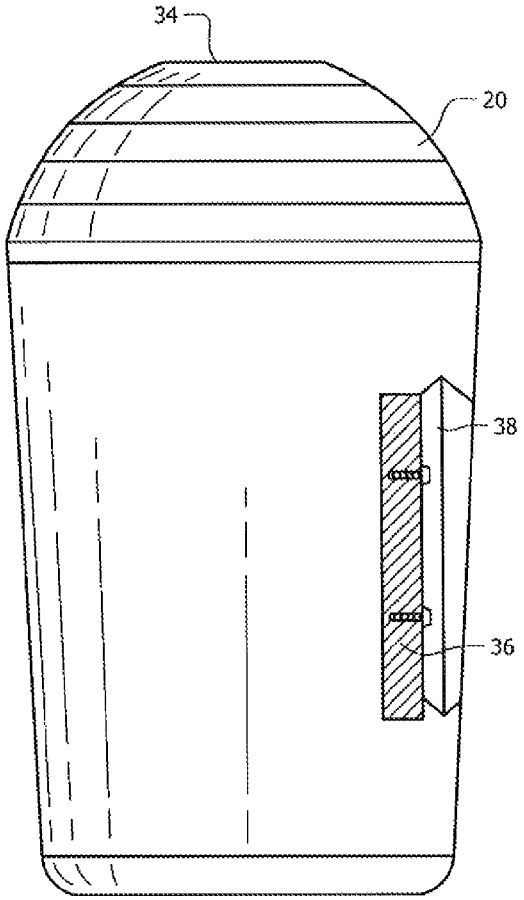
FIG. 5*a* is a side elevation view of an end cap of an improved golf ball retriever, wherein the end cap has a magnetic element in accordance with one embodiment of the present invention.
Figure 5B:
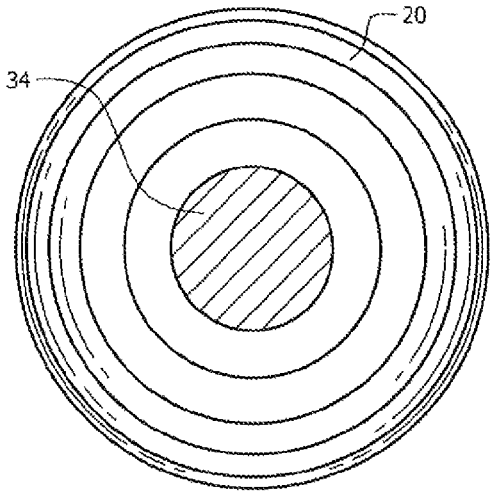
FIG. 5*b* is a top plan view of an end cap of an improved golf ball retriever in accordance with one embodiment of the present invention.

The top end of the shaft 12 includes an end cap 20 that includes threads that mate to the hollow inside of the shaft 12 to enclose the top end of the shaft 12. One skilled in the art will understand that the end cap 20 can also be made to fit snugly inside the shaft 12 so that the end cap 20 may be pushed into the shaft 12 or pulled out of the shaft 12. In accordance with one embodiment of the present invention, the end cap 20 has a diameter of approximately 1" and is made of rubber. In one embodiment of the present disclosure, on the top end of the shaft 12, the shaft 12 also includes apertures 18 to which a hanging device 22 can be attached to the golf ball retriever 10 so that the golf ball retriever 10 can be hung on a player's golf bag. In alternative embodiments, end cap 20 may include aperture 34 to which hanging device 22 may be attached, as shown in FIGS. 5*a* and 5*b*. In such embodiments, when end cap 20 is pushed into the shaft 12, hanging device 22 may be used to hang the golf ball retriever 10 on a player's golf bag. One skilled in the art will understand that the hanging device 22 can be made with any number of materials and maintain the utility of the hanging device 22, such as thread, rubber, or wire. In accordance with one embodiment of the present invention, the diameter of the apertures 18 are approximately ¼" and are drilled into the shaft 12 and the hanging device 22 is approximately 14".

At the top end of the shaft 12, the shaft 12 may also be covered with a tape grip 14 similar to a baseball bat. One skilled in the art will understand that the grip can be comprised of a number of materials and forms, such as a molded rubber grip similar to a golf club. The point at which the inside diameter of the shaft 12 decreases 32 may also be positioned at a point where the optional grip 14 does not cover any portion of the advertising slip 24 when inserted into the shaft 12.

On the opposite end of the shaft 12 from the end cap 20, the golf ball retriever 10 includes a suction cup 16 made of rubber. In accordance with one embodiment of the present invention, the suction cup 16 has a diameter of approximately 1". The suction cup 16 is removably attached to the shaft 12 by the sleeve 28 of the suction cup 16. An advertising slip 24 is constructed from a laminated paper advertisement and has a width, when rolled, that is almost equal to the diameter of the inside of the shaft 12. The advertising slip 24 is rolled by its width to form a tubular shape as in FIG. 2A and is placed inside the shaft 12 with a pole 26. One skilled in the art will understand that the advertising slip 24 can be made from any number of materials, such as any flexible plastic or paper product, without decreasing the utility of the advertising slip 24.

Figure 3:
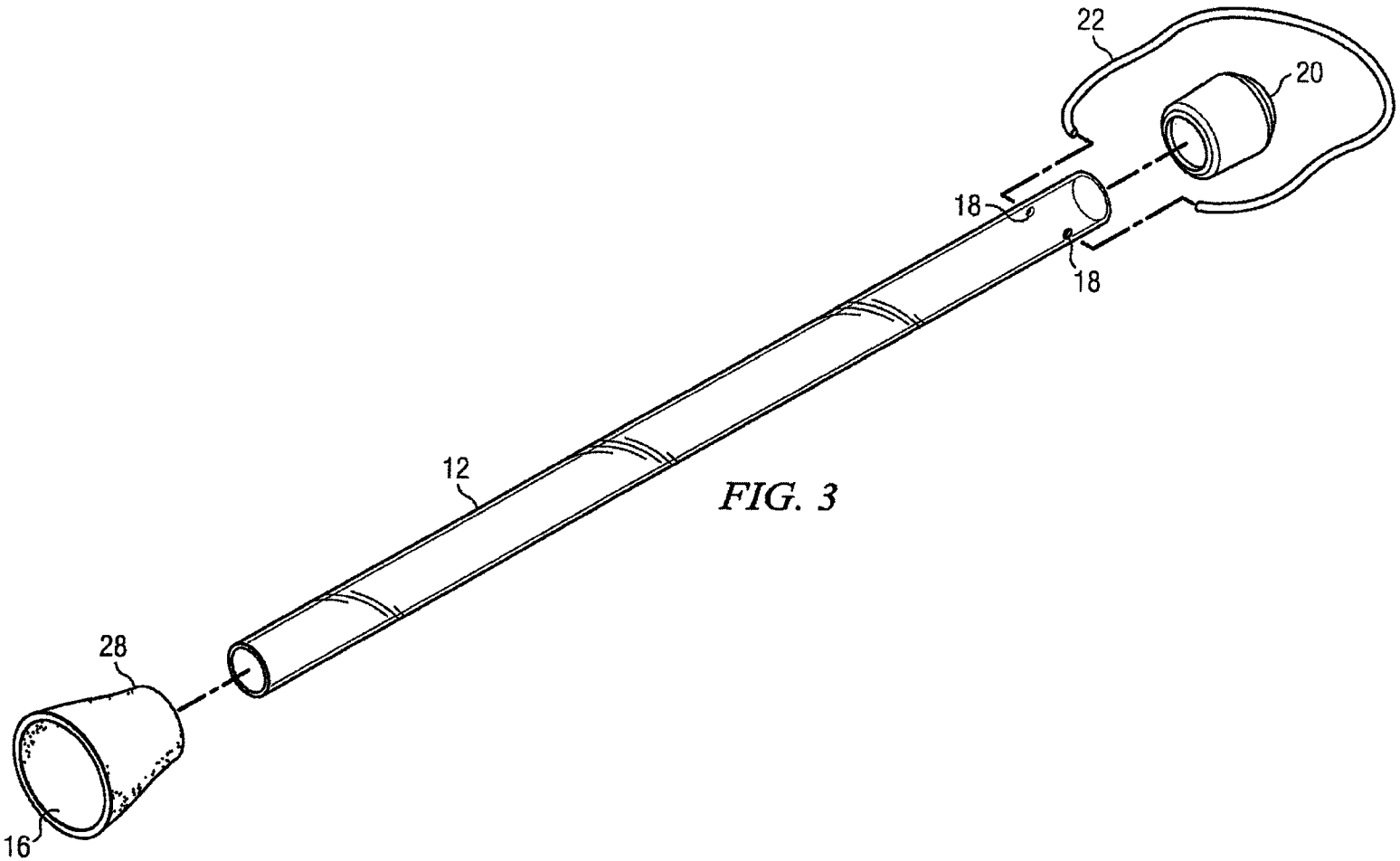
FIG. 3 is an exploded view of an improved golf ball retriever in accordance with one embodiment of the present invention.
Figure 4:
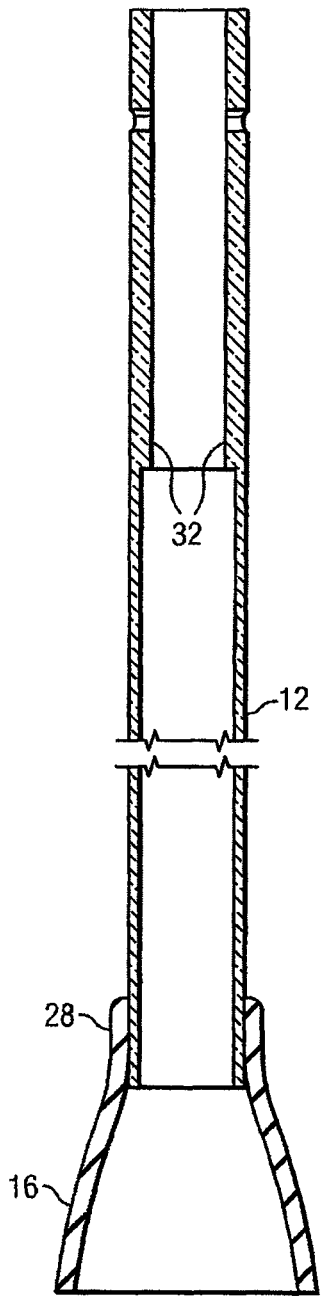
FIG. 4 is cross-section view of an improved golf ball retriever in accordance with one embodiment of the present invention.

FIG. 3 is an exploded view of an improved golf ball retriever 10 in accordance with one embodiment of the present invention. FIG. 4 is a cross-section view of an improved golf ball retriever 10 in accordance with one embodiment of the present invention. To prepare the improved golf ball retriever 10 for use or sale, the suction cup 16 is removed from the shaft 12 by pulling the suction cup sleeve 28 free from the shaft 12. The previously printed advertising slip 24 is then rolled into a cylinder shape, as demonstrated in FIG. 2A, to a diameter that is slightly smaller than the diameter of the inside of the hollow shaft 12. The rolled advertising slip 24 may be secured in its cylinder shape using tape, glue, or any other adhesive material. The advertising slip 24 is then placed inside the shaft 12 and moved to a position inside the clear shaft 12 so that the advertising slip 24 can be seen through the shaft 12 of the golf ball retriever 10. The advertising slip 24 is placed into the shaft 12 of the golf ball retriever 10 with the use of an insertion device that has a diameter just slightly smaller than the diameter of the inside of the shaft 12. The insertion device 26 can be a pole made of any material sturdy enough to push the advertising slip 24 up through the hollow shaft of the golf ball retriever 10. To assure proper placement of the advertising slip 24 within the shaft 12, the diameter of the inside of the shaft can decrease at a predetermined point 32 to stop the advertising slip 24 at the predetermined point.

Once the advertising slip 24 has been placed into the shaft 12 of the golf ball retriever 10, a user can hang the golf ball retriever 10 on his bag using the hanging device 22. The hanging device 22 can be attached to a towel ring on a golfer's bag or any other place that the user desires. When needing to retrieve a ball, the user removes the golf ball retriever 10 from his bag and approaches a ball. Without the need to bend over, the user simply holds the golf ball retriever 10 by the shaft 12 and then places the suction cup 16 over the golf ball. The user then presses the suction cup 16 of the golf ball retriever 10 onto the golf ball and lifts the golf ball retriever 10 with the ball secured in the suction cup 16. If the user desires to continue using the ball that has just been retrieved, he simply removes the golf ball from the suction cup 16.

Golf ball retriever 10 may also include a magnetic element, such as, for example, magnet 38, that may be employed to couple the golf ball retriever 10 to a player's golf cart. FIG. 5*a* depicts a side elevation view of the end cap 20 of the golf ball retriever 10, wherein magnet 38 is coupled to end cap 20 according to one embodiment of the present disclosure.

It should be understood that magnet 38 is shown coupled to end cap 20 for illustrative purposes only and that magnet 38 may be connected to or otherwise coupled to any part of the golf retriever 10.

In one embodiment, end cap 20 may further comprise a protrusion 36 from the molded plastic of the end cap 20. Magnet 38 may be coupled to protrusion 36, such that magnet 38 is fixedly secured to end cap 20.

In another embodiment, end cap 20 may include an aperture (not shown) in the molded plastic of the end cap 20. Magnet 38 may be fixedly secured within the aperture, such that magnet 38 is affixed within the end cap 20.

In alternative embodiments, magnet 38 may be connected or otherwise coupled to end cap 20 in any manner that fixedly secures magnet 38 to end cap 20, such as, for example, using permanent bonding material, or any other suitable method including having male and female coupling adapters, using a bolt, screw or nail, or using other suitable coupling materials, or any combination thereof.

FIG. 5*b* depicts a top plan view of the end cap 20 of the golf ball retriever in accordance with one embodiment of the present invention.

In some embodiments of the present disclosure, end cap 20 may include aperture 34 to which hanging device 22 may be attached. In such embodiments, when end cap 20 is pushed into the shaft 12, hanging device 22 may be used to hang the golf ball retriever 10 on a player's golf bag, as described earlier.

Even though examples discussed herein are applications of the present invention employing an advertising device for an improved golf ball retriever, the present invention can also be employed for use of advertising with other types of retrieving devices, such as those for tennis balls or baseballs.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An advertising device comprising:

a hollow shaft having an interior wall, the hollow shaft formed of a clear material;

a cap on a first end of the hollow shaft;

a cup on a second end of the hollow shaft, the cup being shaped to form to a ball and facing away from the hollow shaft to facilitate retrieving a golf ball; and an advertising slip having an advertisement disposed on an exterior surface thereof, the advertising slip formed and secured into a cylindrical shape and disposed within the hollow shaft;

wherein all of the exterior surface of the advertising slip engages the interior wall of the hollow shaft, and wherein the advertisement is visible through the clear material of the hollow shaft.

2. The advertising device of claim 1, wherein the advertising device further comprises a magnet coupled to the cap.

3. The advertising device of claim 2, wherein the magnet is fixedly secured to the cap.

4. The advertising device of claim 1, wherein the advertising slip is removably disposed within the hollow shaft.

5. The advertising device of claim 1, wherein the hollow shaft is made of acrylic.

6. An advertising device comprising:

a cylindrical hollow shaft made of a clear polymer-based plastic material, the hollow shaft having a first diameter portion, a second diameter portion, a length and an interior wall;

a cap made of a molded resilient material on a first end of the hollow shaft;

a cup made of a molded resilient material on a second end of the hollow shaft, the cup being shaped to form to a golf ball and facing away from the hollow shaft; and an advertising slip disposed within the first diameter portion of the cylindrical hollow shaft, the advertising slip formed into a cylindrical shape that engages the interior wall of the hollow shaft such that the advertising slip displays an advertisement along a portion of the length of the hollow shaft corresponding to the first diameter portion.

7. The advertising device of claim 6, wherein the advertising device further comprises a magnet coupled to the cap.

8. The advertising device of claim 7, wherein the magnet is fixedly secured to the cap.

9. The advertising device of claim 6, wherein the advertising slip is removably disposed within the hollow shaft.

10. The advertising device of claim 6, wherein the hollow shaft is made of acrylic.

11. The advertising device of claim 6, wherein the cap is comprised of a molded rubber compound.

12. The advertising device of claim 6, wherein the cup is comprised of a molded rubber compound.

13. The advertising device of claim 6, wherein the hollow shaft further comprises a hanging means removably disposed near the first end of the hollow shaft.

14. The advertising device of claim 6, wherein the advertising slip is made of a flexible material.

15. The advertising device of claim 14, wherein the flexible material comprises plastic or paper.

16. A method of constructing the advertising device of claim 1, the method comprising:

forming a cylindrical hollow shaft from a clear polymer-based plastic material;

installing a cap made of a molded resilient material to a first end of the hollow shaft;

forming an advertising slip by rolling into a cylinder a flexible material with a printed advertisement thereon, the advertisement disposed on an exterior surface of the advertising slip;

inserting the advertising slip into the hollow shaft through a second end of the hollow shaft using an insertion device such that the exterior surface of the advertising slip engages an interior wall of the hollow shaft to display the advertisement through the clear-polymer based plastic material; and installing a cup made of a molded resilient material to a second end of the hollow shaft, the cup being shaped to form to a golf ball and facing away from the hollow shaft.

17. The method of claim 16, further comprising installing a magnet to the cap.

18. The method of claim 16, further comprising installing a hanging means near the first end of the hollow shaft.

* * * * *